United States Patent [19]

Nowicki

[11] 4,224,368

[45] Sep. 23, 1980

[54] REFLECTIVE HEAT INSULATING SHIELD, SCREEN, OR PANEL

[76] Inventor: Ludwik Nowicki, Pl.P. Gaspard, Bay.6, Appt 41, 38029 Grenoble, France

[21] Appl. No.: 930,202

[22] Filed: Aug. 2, 1978

[30] Foreign Application Priority Data

Aug. 3, 1977 [FR] France ..... 77 24980
Aug. 9, 1977 [DE] Fed. Rep. of Germany ..... 2735776

[51] Int. Cl.[2] ..... B32B 3/28; B32B 3/30

[52] U.S. Cl. ..... 428/178; 428/179; 428/182; 428/913; 428/920

[58] Field of Search ..... 428/182, 178, 174, 179, 428/184, 186, 432, 457, 913, 920; 126/141; 350/102, 202, 292; 220/422

[56] References Cited

U.S. PATENT DOCUMENTS

| | | | |
|---|---|---|---|
| 2,255,748 | 9/1941 | Haggart, Jr. | 350/67 |
| 2,337,167 | 12/1943 | Patton | 350/67 |
| 3,108,279 | 10/1963 | Eisentraut | 350/292 |
| 4,035,539 | 7/1977 | Luboshez | 428/182 |
| 4,082,414 | 4/1978 | Berg | 350/67 |

*Primary Examiner*—Paul J. Thibodeau
*Attorney, Agent, or Firm*—Stevens, Davis, Miller & Mosher

[57] ABSTRACT

A reflective heat insulating shield or screen or panel, for example for disposition between a heating body or source such as a radiator and a wall, comprising a reflective surface having protuberances or facets which face the heating body and deflect the hot air stream flowing along the shield or screen toward the heating body.

5 Claims, 8 Drawing Figures

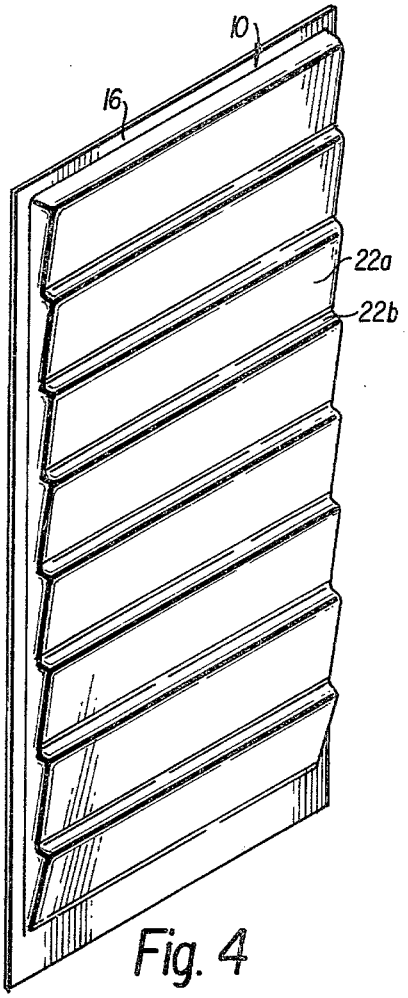
Fig. 4
Fig. 1
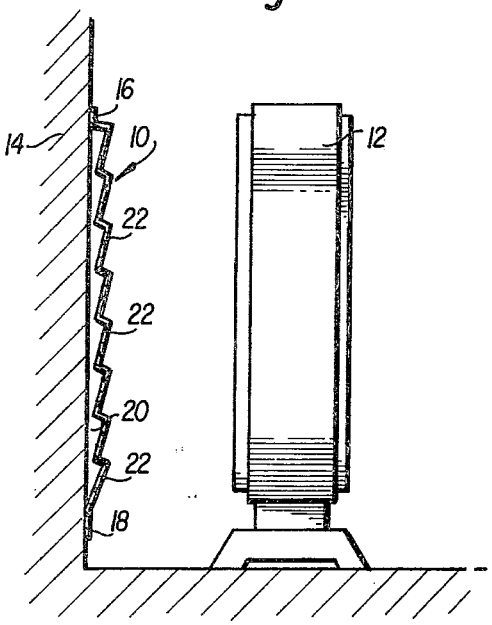
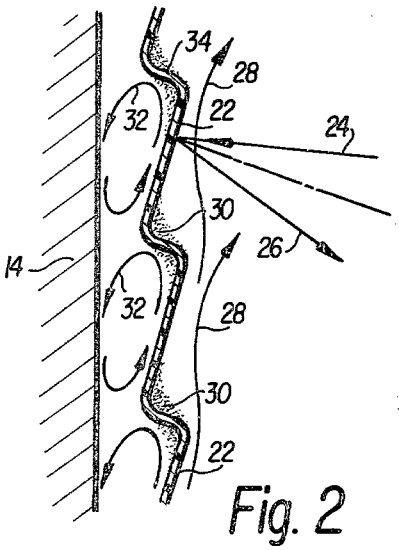
Fig. 2
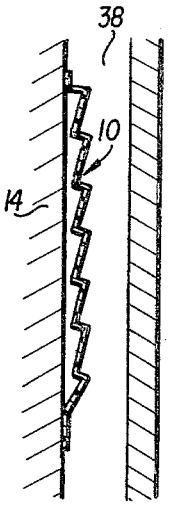
Fig. 3
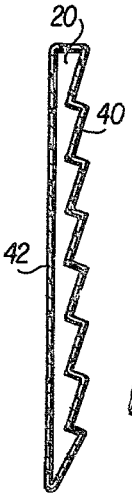
Fig. 5

Fig. 9
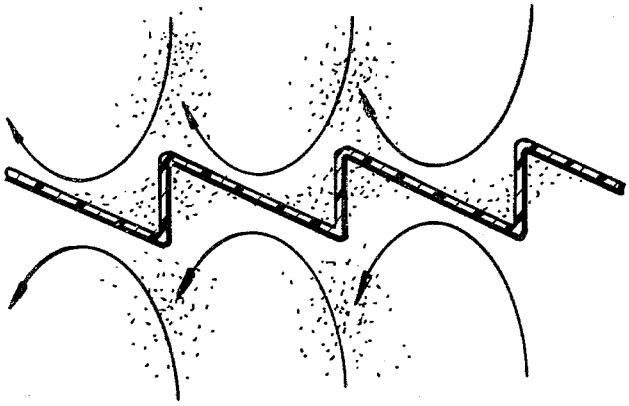
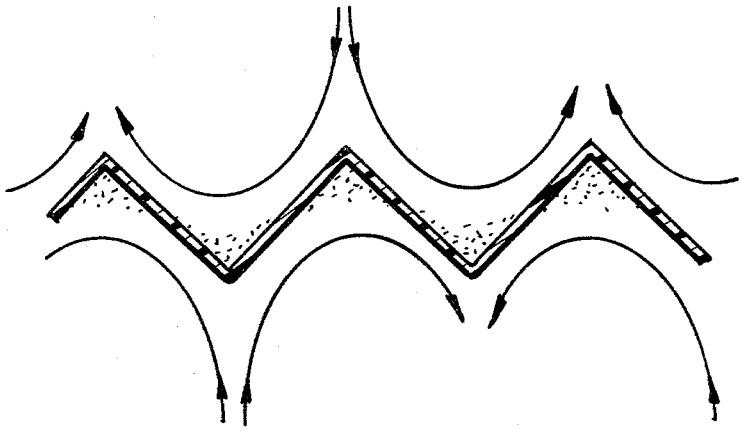
Fig. 10

REFLECTIVE HEAT INSULATING SHIELD, SCREEN, OR PANEL

The invention relates to a heat insulating shield or screen or panel in particular for disposition between a heating body or source and a body such as a wall and having a surface facing the heating body or source which reflects heat rays.

Reflective screens which radiate heat rays back toward a heating body or toward the space to be heated are known. However, their effectiveness is limited, since they act only on the heat radiation and not on the other heat losses. The dust carried by the hot air stream deposits on the reflective surface, and the reflector screen quickly loses its properties. It must be cleaned often which is not always easy, particularly when the screen is inserted between a heating body and the wall. The reflecting surface of this known screen is unesthetic.

The object of the invention is to provide an improved heat insulating shield or screen or panel.

The shield, screen or panel of this invention has a continuous surface with protuberances which form deflecting facets spaced in height and inclined toward the source of heat, particularly in the vertical position of the shield, screen or panel, so as to deflect gases which circulate along the surface toward the heat source. A plurality of smaller protuberances may also be formed on the protuberances or facets.

The circulation of hot gases towards the body, particularly a cold partition or a wall, is prevented by the reflective shield, screen or panel, and these gases which flow along the shield, screen or panel are sent back by the deflecting facets toward the heat source or radiator or the space to be heated. The profile of the face of the shield, screen or panel facing the heat source is advantageously sawtooth in form, and it is easy to understand that each facet throws the stream back, with the formation of a stagnant limiting layer in the hollows of the surface, to constitute an insulating cushion in front of the reflective surface of the shield, screen or panel. This cushion limits the deposition of dust on the reflecting surface, which retains its properties of reflecting the thermal radiation of the radiator.

According to a further feature of the invention, the reflective shield, screen or panel is a stamped or heat-shaped plate or sheet on which there is caused to appear, on the rear face of the shield, screen or panel, opposed to the reflecting surface, a conjugate profile which can block the convective flow on this rear face. This blocking effect is accentuated when the shield, screen or panel is fixed against a wall, by the counter-currents created by the relief of the panel in the interval between the partition and the shield, screen or panel, which is thus subdivided into a great number of cells, ensuring good thermal insulation without thermal contact bridges.

The profile of the sheet confers sufficient rigidity to the sheet even for a very thin sheet of plastic. The fabrication and shaping of such a sheet are simple and easy, and the sheets can be compactly stacked for storage and transportation. The reflective effect can be obtained by coating or depositing on the sheet a layer having a high reflecting power, for example, of aluminum. The profiled sheet can be united to a planar support to form a self-contained hollow cellular structure, which of course possesses the properties mentioned above.

The relfective shield, screen or panel according to the invention, particularly designed to be interposed between a radiator and the adjacent wall where the parasitic losses are considerable, can be utilized in any other location to form a thermal screen, and in particular in air spaces formed within walls or partitions, where it can advantageously replace glass wool or porous plastic insulation. It moreover has the advantage of being unaffected by moisture.

The sawtooth profile according to the present improvement eliminates any mirror effect and lends itslef to decorative patterns. The panel can be semi-transparent for example when it is to be placed in front of a window.

Other advantages and characteristics of the invention will appear more clearly from the following description of embodiments which are given by way of non-limiting example and shown in the attached drawing, in which:

FIG. 1 shows a shield, screen or panel according to the invention, placed between a heating body and a wall;

FIG. 2 shows an enlarged partial illustration of the shield, screen or panel shown in FIG. 1;

FIG. 3 shows a vertical section of a wall with a shield, screen or panel inserted therein;

FIG. 4 is a perspective view of the shield, screen or panel shown in FIG. 1;

FIG. 5 shows another embodiment of the shield, screen or panel; and

Figure 7:
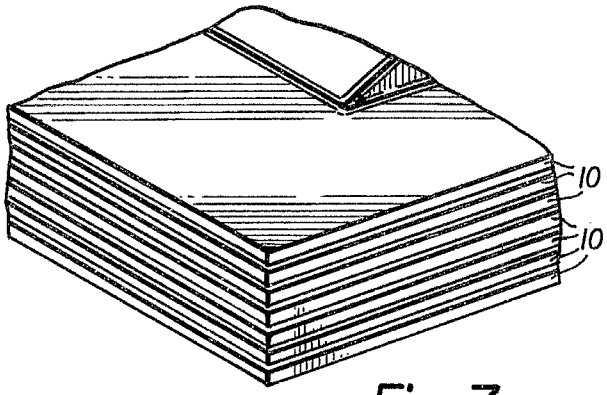
FIG. 7 is an enlarged perspective view showing a plurality of shields, screens or panels stacked for shipping or storage.

In the Figures, a shield, screen or panel 10 is interposed between a source of heat, particularly a central heating radiator 12, and a dividing wall 14. The shield, screen or panel 10 is formed by a continuous surface which extends over the whole height of the radiator 12 and is fixed by its edges 16, 18, for example by gluing, to the wall 14, so as to form an air space 20 between the shield, screen or panel and the wall 14. The surface of the shield, screen or panel 10 has a sawtooth profile with air deflecting members 22 inclined in the direction of the radiator 12. The face of the shield, screen or panel 10 oriented toward the radiator 12 has considerable reflecting power and incident radiation at 24 is reflected by the shield, screen or panel 10 at 26 in the direction of the radiator 12 (see FIG. 2).

The one-piece shield, screen or panel 10 can be a thin sheet, as thin as paper, particularly of heat-shaped or stamped plastic material, such as polyvinyl chloride so as to have on its rear face, opposed to the reflecting face, a conjugate profile, the importance of which will appear more clearly from the explanation of functioning, described with reference to FIG. 2. The convective streams of hot air, shown by the arrows 28 in FIG. 2, rise in the chimney formed between the radiator 12 and the shield, screen or panel 10 and are deflected in the manner indicated by arrows by the air deflecting members 22, toward the radiator 12, with the creation of a limiting layer 30 of stagnant air adjacent the surface of the shield, screen or panel 10, and more particularly in the hollows of the sawtooth profile.

The shield, screen or panel 10 constitutes on the one hand a screen preventing the flow of hot gases towards the cold wall 14, and on the other hand a deflector sending the hot gases rising in the chimney between the radiator and the shield, screen or panel 10 back toward the location to be heated. The limiting layer 30 of stagnant air prevents the deposition of dust on the reflecting facets 22, which thus retain their reflecting power. This limiting layer simultaneously provides a thermal screen between the hot gases and the shield, screen or panel 10.

Figure 8:
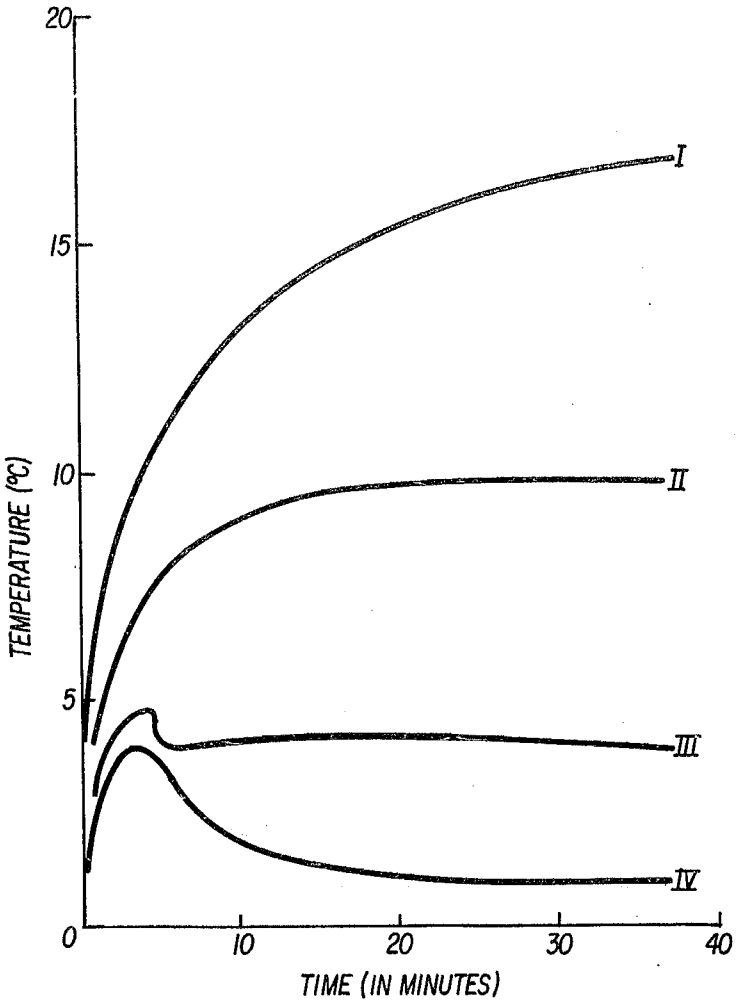
FIG. 8 shows the curves of temperature changes.

The effect of the sawtooth profile is seen from the curves of temperature variation as a function of time given in FIG. 8, in which curve I shows the variation in temperature of the surface of the wall in the absence of a reflective shield, screen or panel 10; curve II shows the variation in temperature of a flat reflective shield, screen or panel; curve IV shows the variation in the temperature of the wall with interposition of a reflective shield, screen or panel with a sawtooth profile, of the type illustrated in FIG. 2; and curve III shows the variation of temperature at the level of the shield, screen or panel 10 with a sawtooth profile. The difference in temperature between curves II and III is due to the front face, with inclined facets 22, modifying the convective flow along the shield, screen or panel 10.

The conjugate profile on the rear face of the shield, screen or panel 10 permits the space 20 formed between the shield, screen or panel 10 and the wall 14 to be subdivided into elementary spaces or cells, blocking the convective flow in this space. Between the bottom of the teeth of the shield, screen or panel 10 projecting in the direction of the wall 14 and the wall, there is a break in continuity which prevents transmission by thermal conduction. This break in continuity is bridged by a fluid screen represented by arrows 32 in FIG. 2. Inside the space 20, the hot gases rise and are deflected by the substantially horizontal parts or ledges 34 of the sawtooth profile toward the wall 14, such that a circular movement is formed for each cell corresponding to a tooth of the profile. Each of the air deflecting members 22 is substantially longer than and extends radially outwardly from adjacent the base of a corresponding one of the ledges 34. This blocking of convective flows in the space 20, which appears as a formation of thermally insulating air cushions, improves the thermal insulation provided by the shield, screen or panel 10. This improvement is clearly shown by curve IV of FIG. 8, which shows the variation in temperature of the wall 14 compared to the variation in temperature of the shield, screen or panel 10, shown by curve III.

The sawtooth profile confers sufficient rigidity on the shield, screen or panel 10, to make it self-supporting even when the shield, screen or panel is a single thin sheet of heat-shaped or stamped plastic, such as polyvinyl chloride.

A perspective view of one of the shields, screens or panels 10 is shown in FIG. 4. As shown in FIG. 7, because of their thinness and shape, the shields, screens or panels 10 can easily be compactly stacked for storage or transportation, and they can easily be fixed in place because of their light weight.

The front face of the shield, screen or panel 10 can be coated with a layer of a material having a high reflecting power, for example, with a layer of aluminum, or can receive, for example by gluing, a thin sheet of aluminum. The height of each tooth of the profile may be one or several centimeters. The shield, screen or panel 10 can be made of a translucent or transparent material, which is of particular interest when a radiator is disposed in front of a window or glazed partition, where the interposition of the shield, screen or panel 10 should not reduce the illumination of the room. The inclined facets 22 have in themselves a decorative effect, which can be accentuated by any appropriate means. The downward inclination of the facets 22 reduces the deposition of dust and prevents any reflection of luminous rays in the direction of the room and any mirror effect which could trouble the occupants.

Shields, screens or panels of the type shown in FIG. 4 have been constructed. Each panel has a total weight of 210 g/m$^2$, a total thickness of about 1 cm, is approximately 12 cm wide and approximately 23.5 cm long and is divided into 8 sections each forming a facet or protuberance 22. The front face **22*a* of each protuberance is approximately 2.8 cm long and the top face 22*b*** is approximately 0.5 cm wide. Each panel weighs approximately 7.5 g and is made of polyvinyl chloride having a silver colored reflective surface, of vacuum deposited aluminum.

Individual shields, screens or panels may be assembled end to end and side to side to form larger shields, screens or panels of any desired size.

Figure 6:
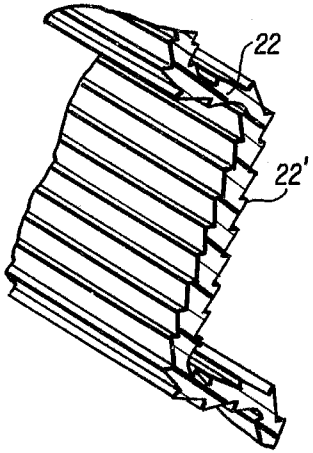
FIG. 6 is an enlarged perspective view of another embodiment of the invention.

Another embodiment of the invention is shown in FIG. 6. In that embodiment, a plurality of smaller protuberances 22', which can be for example 1/10 the size of the protuberances 22, are formed on the protuberances 22. The smaller protuberances 22' function to create small circular air flow paths thereadjacent, as shown in FIG. 6, from the slow convection flow thereadjacent. Without the smaller protuberances 22', the convection flow, because of its slow speed, could flow around the large protuberances 22. The smaller protuberances can be formed for example by roughing the surfaces of the protuberances 22.

The reflective shield, screen or panel according to the invention, particularly designed to be interposed between a radiator 12 and a dividing wall 14 where the problem of heat exchange is important, can of course be used for other applications. FIG. 3 illustrates, by way of example, the disposition of a reflective shield, screen or panel 10 according to the invention in the air space 38 of a wall 14. The shield, screen or panel 10 is in thermal contact with the wall 14 only by its ends, and all conduction is practically prevented because of this. The blocking of convective streams at the front and rear of the shield, screen or panel is effected in the way described above, as is the reflection of rays.

FIG. 5 shows a self-contained modular assembly constituted by a sawtooth profile 40 fixed to a rear support plate 42, so as to form a space 20, analogous to that shown in FIG. 1. The assembly can be of a hollow plastic material, and behaves like a cellular thermal insulator. Its functioning is of course identical to that described above.

The reflective shield, screen or panel according to the invention advantageously replaces conventional thermal screens, such as glass wool or porous materials, and has the advantage of retaining its properties even in a damp environment, and of having a weight which is lower by a factor of as much as 3 to 10. As pointed out above, several modules can, of course, be associated to constitute multiple screens or screens of greater surface area.

The reflective shield, screen or panel according to the invention can be applied in horizontal position. The relative convection flows for a sawtooth profile are shown in FIG. 9, where the convection blockade areas are powdered. FIG. 10 shows the convection flows modes for a symmetrical profile, where no convection blockade occurs.

The invention is, of course, not limited to the particular embodiment described and shown in the attached drawing, but includes variations thereof which will occur to persons skilled in the art.

What is claimed is:

1. A heat reflective heat insulating sheet-like panel positioned between a source of heat and an adjacent body for limiting thermal exchange by radiation and by convection between the source and the body, said panel comprising:

a thin wall having continuous interior and exterior surfaces defined by a plurality of outwardly extending first ledges and by a plurality of first air deflecting members between next adjacent pairs of the ledges, each of the air deflecting members being substantially longer than and extending outwardly from adjacent the base of a corresponding one of the ledges and terminating adjacent the tip of the ledge next adjacent to said one ledge, and a plurality of second outwardly extending ledges considerably shorter than the first ledges on each of the first air deflecting members and a plurality of second air deflecting members considerably shorter than the first air deflecting members extending outwardly from the base of a corresponding one of the second ledges and terminating adjacent the tip of the second ledge next adjacent to said one second ledge.

2. A one-piece heat relfective heat insulating thin sheet-like panel positioned between a source of heat and a substantially planar static support structure to which the panel is attached adjacent its ends for limiting thermal exchange by radiation and by convection between the source and the support structure, said panel comprising:

a one-piece wall of thin sheet material having continuous interior and reflective exterior surfaces defined by a plurality of outwardly extending ledges and by a plurality of air deflecting members between next adjacent pairs of the ledges, each of the air deflecting members being substantially longer than and extending outwardly from adjacent the base of a corresponding one of the ledges and terminating adjacent the tip of the ledge next adjacent to said one ledge, and said panel being spaced throughout substantially its entire extent except at the points of attachment a small distance from said static structure and defining a closed space therebetween, and except for the points of attachment between the static structure and the thin wall the entire length of the panel is substantially free of thermal bridges.

3. A one-piece heat reflective heat insulating thin sheet-like panel positioned between a source of heat and an adjacent body for limiting thermal exchange by radiation and by convection between the source and the body, said panel comprising:

a front wall having continuous interior and reflective exterior surfaces defined by a plurality of outwardly extending ledges and by a plurality of air deflecting members between next adjacent pairs of the ledges, each of the air deflecting members being substantially longer than and extending outwardly from adjacent the base of a corresponding one of the ledges and terminating adjacent the tip of the ledge next adjacent to said one ledge; a back wall affixed at its ends to and spaced a small distance from said front wall and defining a closed space therebetween, and except for the points of attachment between the front wall and the back wall the entire length of the panel is substantially free of thermal bridges.

4. A one-piece heat reflective heat insulating thin sheet-like panel positioned between a source of heat and a substantially planar static support structure to which the panel is attached adjacent its ends for limiting thermal exchange by radiation and by convection between the source and the support structure, said panel comprising:

a one-piece thin wall of sheet material sawtooth-shaped in longitudinal cross-section and having continuous interior and reflective exterior surfaces of sawtooth shape in longitudinal cross-section; and said panel being spaced throughout substantially its entire extent except at the points of attachment a small distance from said static structure and defining a closed space therebetween, and except for the points of attachment between the static structure and the thin wall the entire length of the panel is substantially free of thermal bridges.

5. A one-piece heat reflective heat insulating thin sheet-like panel positioned between a source of heat and an adjacent body for limiting thermal exchange by radiation and by convection between the source and the body, said panel comprising:

a front wall sawtooth-shaped in longitudinal cross-section and having continuous interior and reflective exterior surfaces of sawtooth shape in longitudinal cross-section and a back wall attached only at its ends to and spaced a small distance throughout substantially its entire extent from said front wall except at the points of attachment and defining a closed space therebetween, and except for the points of attachment between the front wall and the back wall the entire length of the panel is substantially free of thermal bridges.

* * * * *